US008641457B2

(12) United States Patent
Watson et al.

(10) Patent No.: US 8,641,457 B2
(45) Date of Patent: Feb. 4, 2014

(54) SYSTEM AND METHOD FOR CONNECTING A POWER CABLE WITH A SUBMERSIBLE COMPONENT

(75) Inventors: Arthur I. Watson, Sugar Land, TX (US); Gregory H. Manke, Overland Park, KS (US); Wayne L. Costa, Edmond, OK (US); Kevin T. Scarsdale, Pearland, TX (US); Chris E. Featherby, Bartlesville, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1249 days.

(21) Appl. No.: 12/141,468

(22) Filed: Jun. 18, 2008

(65) Prior Publication Data

US 2009/0317997 A1 Dec. 24, 2009

(51) Int. Cl.
*H01R 13/42* (2006.01)

(52) U.S. Cl.
USPC ..... 439/738

(58) Field of Classification Search
USPC ..... 439/738, 752, 695, 589, 587
See application file for complete search history.

(56) References Cited

U.S. PATENT DOCUMENTS

| | | | | |
|---|---|---|---|---|
| 3,248,582 | A * | 4/1966 | Brown | 310/87 |
| 3,604,964 | A * | 9/1971 | Conrad et al. | 310/71 |
| 3,952,218 | A * | 4/1976 | Deters | 310/71 |
| 4,583,804 | A * | 4/1986 | Thompson | 439/588 |
| 4,693,534 | A * | 9/1987 | Clark | 439/276 |
| 5,286,220 | A * | 2/1994 | Watson | 439/589 |
| 5,366,018 | A * | 11/1994 | Van Steenwyk et al. | 166/385 |
| 6,397,945 | B1 | 6/2002 | Manke et al. | |
| 6,409,485 | B1 | 6/2002 | Ebner | |
| 6,910,870 | B2 * | 6/2005 | Ebner | 417/422 |
| 7,878,851 | B2 * | 2/2011 | Silva et al. | 439/589 |
| 2006/0148304 | A1 * | 7/2006 | Kennedy et al. | 439/404 |

* cited by examiner

*Primary Examiner* — Neil Abrams
*Assistant Examiner* — Phuong T Nguyen
(74) *Attorney, Agent, or Firm* — Jim Patterson

(57) ABSTRACT

A technique is provided for connecting a power cable to a submersible component. A connector system is used to form the connection and comprises a plurality of individual connectors for connecting power carrying conductors to the submersible component. Each of the individual connectors is separately connectable to the submersible component which enables improved sealing with respect to the submersible component. In multi-phase power applications, individual connectors can be used for each phase.

29 Claims, 4 Drawing Sheets

SYSTEM AND METHOD FOR CONNECTING A POWER CABLE WITH A SUBMERSIBLE COMPONENT

BACKGROUND

In a variety of well applications, electrical power is delivered to downhole components. For example, electric submersible pumping system applications use submersible electric motors that are powered via a power cable run downhole along a tubing string. The power cable is connected to the submersible electric motor by a connector, sometimes referred to as a pothead.

Because of the high pressure, high temperature, harsh wellbore environment, the connector is designed to protect both the power cable and the powered component from the environmental factors. A variety of elastomeric elements are employed to help form seals between the pothead and both the submersible motor and the power cable. The submersible motor is generally a three-phase motor, and the pothead is designed as a single connector having a triad configuration of three conductors for carrying three-phase power. Difficulties can arise in adequately sealing the pothead against the deleterious effects of the harsh downhole environment over substantial periods of submersible motor operation.

SUMMARY

In general, the present invention provides a system and method for connecting a power cable to a submersible component. A connector system comprises a plurality of individual connectors for connecting power carrying conductors to the submersible component. Each of the individual connectors is separately connectable to the submersible component which enables improved sealing with respect to the submersible component. When multi-phase power is provided to the submersible component, an individual connector can be used for each phase.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for connecting a multi-conductor power cable to a submersible component in a high temperature environment. For example, the connection system can be used in a harsh, high temperature, high pressure well environment for connecting a power cable to a submersible motor. The connection system uses a plurality of individual connectors coupled to the power cable and separately connectable to the submersible component. The individual, separate connectors avoid the traditional requirement of a single connector pothead for electrically coupling a plurality of conductors to a submersible component.

In many applications, the connection system enables two or more individual connections to be made with corresponding submersible component contacts. For example, if three-phase power is provided to a submersible electric motor, individual connectors can be used for each phase. In one embodiment, the connector for each electrical input phase uses an outer metallic tubing which seals to a motor housing via a metal-to-metal connection that requires no elastomer sealing elements. By way of example, each metal-to-metal sealed connection can be formed and maintained with a compression fitting.

Figure 1:
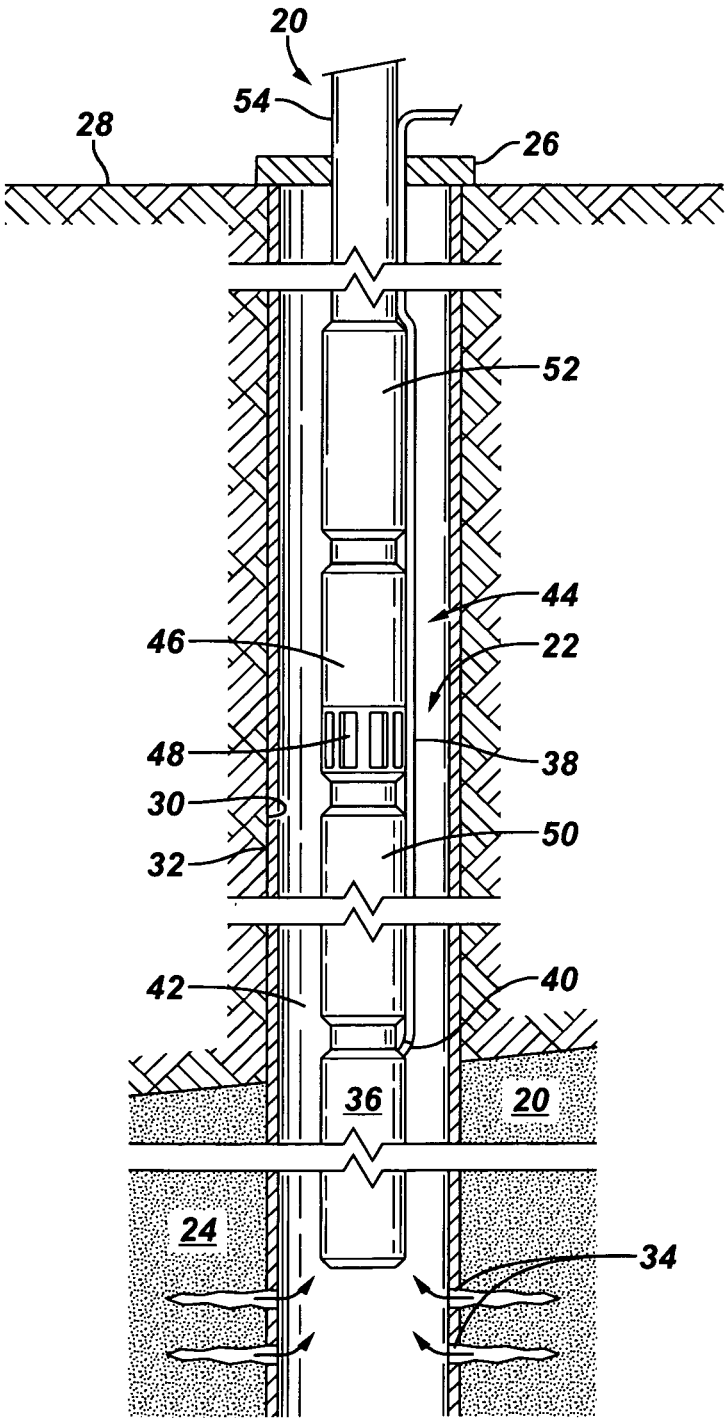
FIG. 1 is a front elevation view of a powered system deployed in a wellbore, according to an embodiment of the present invention.

Referring generally to FIG. 1, a well system 20 is illustrated as deployed in a wellbore 22 according to one embodiment of the present invention. The wellbore 22 is illustrated as extending downwardly to a subterranean formation 24, e.g. a hydrocarbon reservoir, from a wellhead 26 positioned at a surface location 28. The well system 20 can be utilized in a variety of wells having generally vertical or deviated wellbores. As illustrated, wellbore 22 is defined by a surrounding wellbore wall 30 that may be an open wellbore wall, a casing, or a combination of cased and open sections. In the example illustrated, wellbore wall 30 is defined by a casing 32 having perforations 34 that allow communication between wellbore 22 and the surrounding formation 24. For example, a production fluid, e.g. a hydrocarbon based fluid, can flow from formation 24, through perforations 34, and into wellbore 22.

The well system 20 may comprise a variety of well systems used to perform many types of well related operations. In general, the well system 20 comprises at least one submersible, electrically powered component 36 that receives power via an electric power cable 38. Power cable 38 is mechanically and electrically connected to submersible component 36 by a connector system 40. Connector system 40 is sealed with respect to submersible component 36 and power cable 38 to protect both component 36 and cable 38 from the high pressure, high temperature, harsh wellbore environment 42. The harsh wellbore environment 42 is typically at a temperature of greater than 300 degrees Fahrenheit and under substantial pressure. Additionally, a variety of harsh gases, liquids and other substances found in wellbore environment 42 can have deleterious effects on submersible component 36 and/or power cable 38 if the seal is not maintained.

In the embodiment illustrated in FIG. 1, submersible component 36 comprises an electric motor that is part of an overall electric submersible pumping system 44, however submersible component 36 can comprise a variety of other powered components in other systems. In the example illustrated, electric submersible pumping system 44 comprises a submersible pump 46 that draws well fluid into a pump intake 48 when powered by submersible electric motor 36. Additionally, a motor protector 50 can be deployed between submersible motor 36 and submersible pump 46. In this embodiment, a pumping system connector 52 can be used to couple pumping system 44 to a conveyance 54. By way of example, conveyance 54 may comprise a tubing, such as a production tubing or coiled tubing. In other applications, conveyance 54 may be a cable-type conveyance or another suitable conveyance. Power cable 38 may be routed downhole along an interior or an exterior of the conveyance 54.

Figure 2:
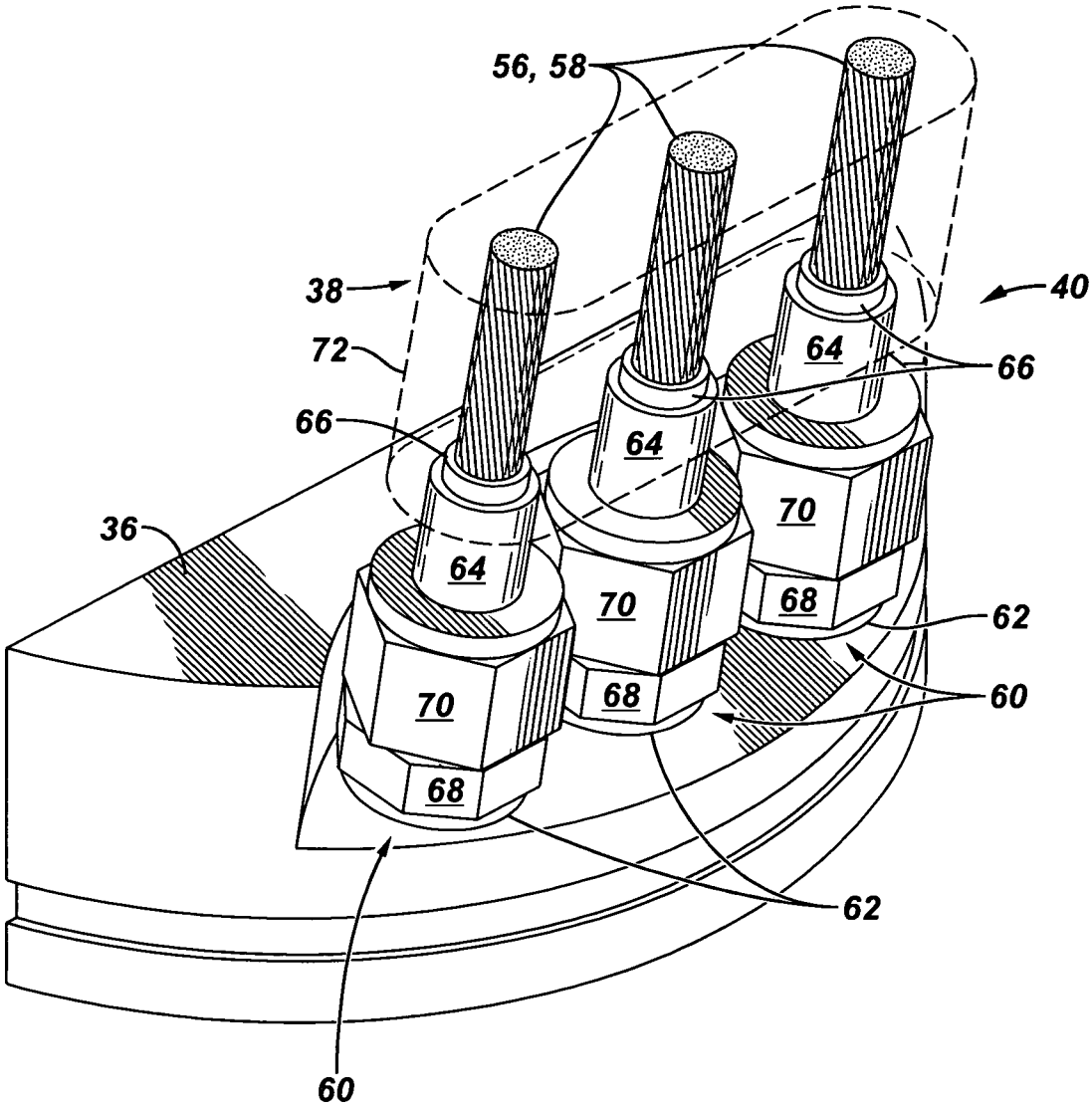
FIG. 2 is an orthogonal view of a connector system used to connect a power cable to a powered submersible component, according to an embodiment of the present invention.

Connector system 40 is designed to improve the dependability of the connection between power cable 38 and submersible powered component 36. In FIG. 2, one example of connector system 40 is illustrated. In this embodiment, connector system 40 is designed to enable separate connection of individual phases. If a three-phase power signal is delivered to submersible component 36, for example, connector system 40 separates the three phases 56 carried by conductors 58, e.g. copper conductors. The connector system 40 further enables connection to submersible component 36 via three individual and separately connectable connectors 60. Connector system 40 can be referred to as a pothead that enables individual connection and disconnection of conductors or phases used to deliver power to a submersible component.

In the embodiment illustrated, each individual connector 60 is separately connected and disconnected with a corresponding connector region 62 of submersible component 36, e.g. a submersible electric motor. Each connection with submersible component 36 may be formed as a sealed metal-to-metal connection to limit or avoid the use of conventional elastomer seal elements. In one example, each connector 60 comprises a sleeve 64 that may be formed of a metallic material. Each sleeve 64 surrounds a corresponding conductor 58 and is separated from the corresponding conductor 58 by an insulation layer 66. Each sleeve 64 may be used to facilitate the metal-to-metal seal with the submersible component 36 and to further facilitate a seal with power cable 38.

Individual sealed connections can be formed with various components having a number of configurations. In the embodiment illustrated, however, each connector 60 is in the form of a compression fitting having a male compression thread fitting 68 that is attached to submersible component 36 by a threaded engagement, a weldment, or another suitable attachment mechanism. Each illustrated connector 60 further comprises a female compression thread fitting 70 that couples the corresponding sleeve 64 to the male compression thread fitting 68. Male compression thread fitting 68 and female compression thread fitting 70 are threaded together and sufficiently torqued to provide the pressure seal needed to prevent wellbore fluids from entering submersible component 36.

Each of the sleeves 64 can be formed from various materials that allow the male and female compression thread fittings 68, 70 to grip onto the sleeve 64 and provide the necessary seal. Additionally, each individual sleeve 64 may be sealed to the underlying insulation layer 66 used on the corresponding conductor 58 to further provide a barrier against wellbore fluids entering submersible component 36.

With respect to power cable 38, each sleeve 64 is used to form a seal with the connection end of the power cable. For example, each sleeve 64 can be sealed with respect to a jacket 72, e.g. a lead jacket, of the power cable 38 and/or with the conductor insulation layer 66 surrounding each conductor 58. The sealed connection can be accomplished according to several techniques, including soldering or welding between each sleeve 64 and the power cable jacket 72. Alternatively, each sleeve 64 can be taped with respect to the jacket 72 and/or insulation layer 66. In other embodiments, adhesives can be used to bind each sleeve 64 to the jacket 72 and/or conductor insulation 66. The seals formed between connector system 40 and submersible component 36/power cable 38 are capable of continuous operation in a well environment at temperatures greater than 300 degrees Fahrenheit.

The connector system 40 also can be used to facilitate formation of electrical connections between the power cable 38 and the submersible component 36. For example, an electrical connection can be made for each phase by connecting individual conductors 58 with submersible component 36 via plug-in style connections or tape-in style connections.

Figure 3:
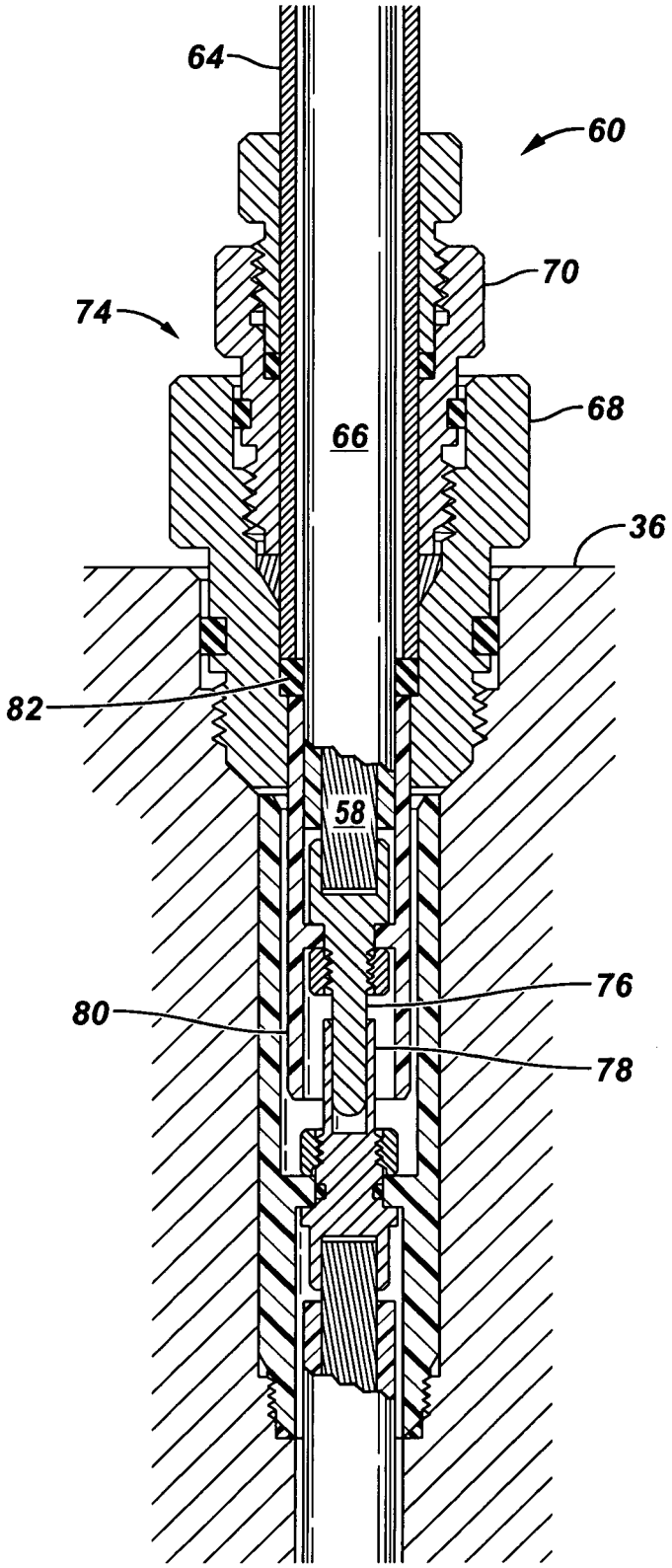
FIG. 3 is a schematic sectional view of one type of individual connector for use with the connector system illustrated in FIG. 2, according to an embodiment of the present invention.

Referring generally to FIG. 3, a section view of a plug-in style connection for an individual connector 60 is illustrated. In this embodiment, one example of an individual connector housing 74 is illustrated. By way of example, the individual connector housing 74 can be formed as part of, or positioned within, compression thread fitting 68. The plug-in style connection enables direct electrical connection between the conductor 58 and a submersible component 36 at each individual connector 60 without requiring additional taping.

As illustrated, each conductor 58 terminates with a terminal 76 designed for engagement with a corresponding contact 78 of submersible component 36. Each terminal 76 is surrounded by a shroud 80 which may be formed from an insulation grade molded or machined material. Additionally, a seal member 82, such as an elastomeric seal, can be disposed within individual connector housing 74. During connection of the individual connector 60 to submersible component 36, the seal member 82 is energized to seal between, for example, conductor insulation 66 and connector housing 74.

Figure 4:
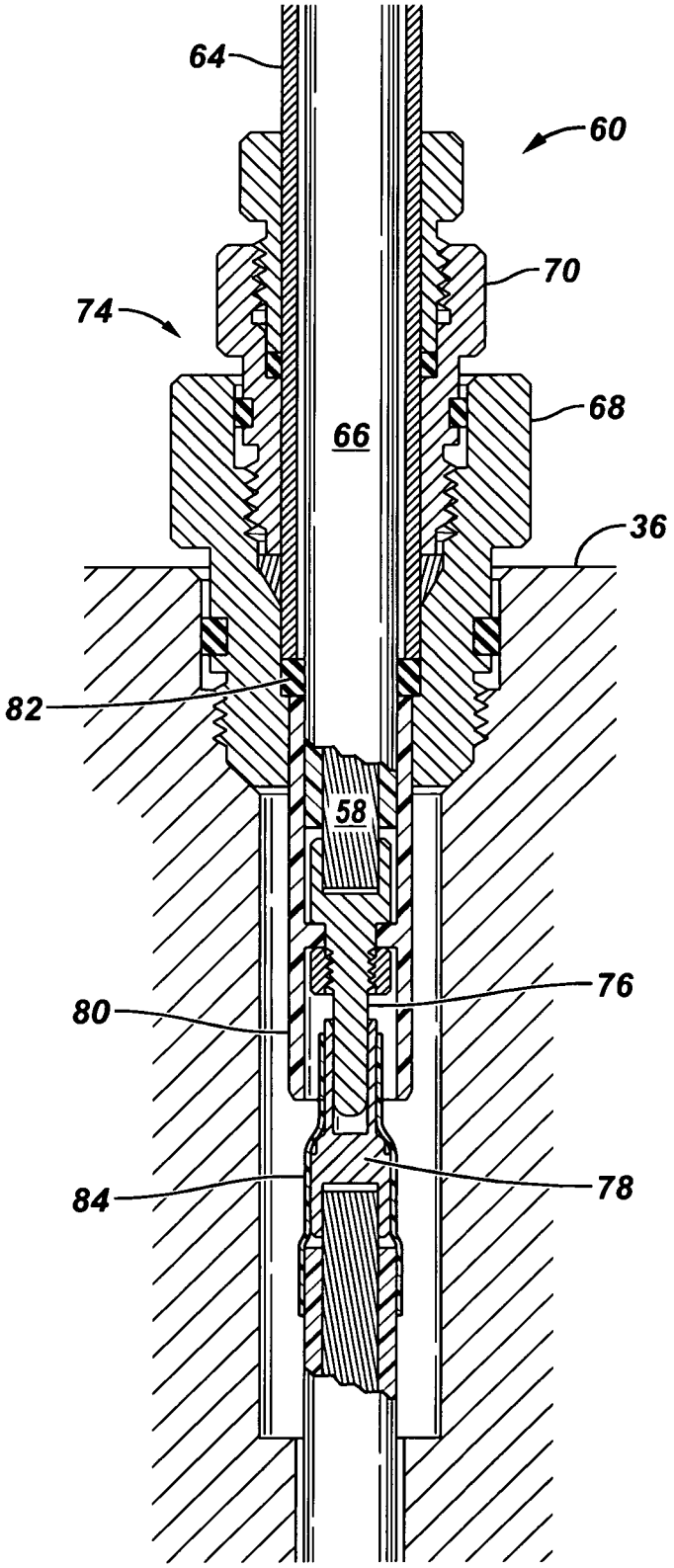
FIG. 4 is a schematic sectional view of another type of individual connector for use with the connector system illustrated in FIG. 2, according to an alternate embodiment of the present invention.

In another embodiment, the electrical connection is formed via a tape-in style connection, as illustrated in FIG. 4. A tape-in style connection allows motor brush wires to be pulled through a motor hole and fastened to terminals, e.g. terminals 76, to form the electrical connection with the power cable 38. A dialectic tape is applied over the terminal connection to provide electrical insulation over the otherwise bare terminals.

Referring generally to FIG. 4, a section view of a tape-in style connection for an individual connector 60 is illustrated. In this embodiment, the individual connector housing 74 can, again, be formed as part of, or positioned within, compression thread fitting 68. The tape-in style pothead connector allows the motor brush wires at each connector 60 to be pulled from submersible component 36, e.g. a submersible motor, and fastened to the pothead terminal 76. A tape 84 is then applied over the terminal connection to provide electrical insulation over the terminal. The seal member 82 can be similarly positioned within individual connector housing 74. During connection of the individual connector 60 to submersible component 36, the seal member 82 is energized to seal between, for example, conductor insulation 66 and connector housing 74.

The pothead design, in which individual connectors 60 are used to connect a plurality of individual conductors/phases to a powered submersible component, promotes improved reliability and durability of the connection. Furthermore, formation of a metal-to-metal connection between a portion of each individual connector and a submersible component housing further promotes the longevity of the connector by eliminating materials susceptible to the detrimental effects of the harsh wellbore environment. It should be noted, however, that a variety of connector components can be used to form the mechanical connection between the individual connectors and the powered submersible component. Similarly, a variety of structural components and techniques can be used to mechanically seal each connector to the power cable. Additionally, various components and techniques can be used to form the electrical connection between each conductor/phase of the power cable and the corresponding contact of the submersible component via the individual connector.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for use in a well, comprising:

a power cable having a plurality of conductors for carrying a three-phase electric signal;

a submersible component powered by the three-phase electric signal; and a connector system connecting the power cable to the submersible component, the connector system having a plurality of individual connectors with each individual connector being separately connectable to the submersible component for carrying an individual phase of the three-phase electric signal, each individual connector being independently fastened to the submersible component to form a sealed connection with the submersible component independent of the other individual connectors.

2. The system as recited in claim 1, wherein the plurality of conductors comprise three conductors.

3. The system as recited in claim 1, wherein each individual connector comprises a plug-in style connector.

4. The system as recited in claim 1, wherein each individual connector comprises a tape-in style connector.

5. The system as recited in claim 1, wherein the submersible component comprises a submersible electric motor powered by the three-phase electric signal.

6. The system as recited in claim 5, further comprising a submersible pump powered by the submersible electric motor.

7. The system as recited in claim 1, wherein each individual connector comprises a metallic tubing which seals to a housing of the submersible component via a metal-to-metal connection.

8. The system as recited in claim 7, wherein the metal-to-metal connection comprises a compression fitting.

9. The system as recited in claim 7, wherein each individual connector further comprises an insulation layer between the metallic tubing and the conductor.

10. A method, comprising:

forming a connector system with a plurality of individual connectors for connecting each phase of a power cable;

separately connecting each phase of the power cable to a submersible component with an individual connector of the plurality of connectors; and independently securing the individual connector to the submersible component separately from the other individual connectors.

11. The method as recited in claim 10, further comprising moving the submersible component downhole to a high temperature well environment.

12. The method as recited in claim 10, wherein separately connecting comprises connecting each phase of the power cable to a submersible motor of an electric submersible pumping system.

13. The method as recited in claim 10, wherein separately connecting comprises establishing a separate metal-to-metal seal between each individual connector and the submersible component.

14. The method as recited in claim 13, wherein forming comprises forming each individual connector with a sleeve surrounding a conductor.

15. The method as recited in claim 14, wherein establishing comprises establishing the seal between the sleeve and a housing of the submersible component for each phase.

16. A device, comprising:

a submersible, high temperature pothead to provide an electric connection between a multi-phase power cable and a submersible component, the submersible high-temperature pothead having a plurality of connectors that are separately connectable to the submersible component to separately connect each phase, wherein each connector limits use of elastomer sealing elements by forming a mechanical, metal-to-metal seal with the submersible component and each connector is individually fastened and sealed to the submersible component.

17. The device as recited in claim 16, wherein the submersible high-temperature pothead comprises three connectors.

18. The device as recited in claim 17, wherein each connector comprises a compression fitting.

19. The device as recited in claim 18, wherein each connector comprises a conductor surrounded by a sleeve positioned to form a separate metal-to-metal seal with a housing of the submersible component.

20. The device as recited in claim 19, wherein the sleeve is sealed with respect to a surrounding jacket.

21. The device as recited in claim 19, wherein the sleeve is sealed with respect to a surrounding jacket via soldering.

22. The device as recited in claim 19, wherein the sleeve is sealed with respect to a surrounding jacket via welding.

23. A method, comprising:

supplying three-phase power to a submersible component in a wellbore via a power cable;

forming a separate connection for each phase by using a plurality of individual connectors that may each be individually connected to the submersible component; and sealing each individual connector between the submersible component and the power cable by securing each individual connector to the submersible component independently of the other individual connectors.

24. The method as recited in claim 23, wherein sealing comprises limiting the use of elastomeric seal elements by forming a metal-to-metal seal for each phase.

25. The method as recited in claim 23, wherein forming comprises constructing each individual connector with a sleeve surrounding a conductor but separated from the conductor with an insulation layer.

26. The method as recited in claim 25, further comprising creating a seal between the sleeve and a surrounding cable jacket.

27. The method as recited in claim 25, further comprising creating a seal between the sleeve and a surrounding cable jacket via soldering.

28. The method as recited in claim 25, further comprising creating a seal between the sleeve and a surrounding cable jacket via welding.

29. The method as recited in claim 25, wherein sealing comprises using each sleeve to form a sealed connection between the power cable and the submersible component.

* * * * *